US005249336A

United States Patent [19]

Miller

[11] Patent Number: 5,249,336

[45] Date of Patent: Oct. 5, 1993

[54] PLASTIC COVERED BINDER CLIP

[75] Inventor: Joseph T. Miller, Mehlville, Mo.

[73] Assignee: Mocap, Inc., St. Louis, Mo.

[21] Appl. No.: 957,016

[22] Filed: Oct. 5, 1992

[51] Int. Cl.[5] ..... B42F 1/02

[52] U.S. Cl. ..... 24/67.5; 24/303; 248/206.5

[58] Field of Search ..... 24/67.9, 67.3, 67.5, 24/557, 558, 303; 248/206.5, 683; 40/641; 81/427.5; 273/75; 74/551.9, 558, 558.5, 528, 523

[56] References Cited

U.S. PATENT DOCUMENTS 2,458,725 1/1949 Penman ..... 81/427.5 X
3,225,469 12/1965 Chase ..... 24/67.3 X
4,304,158 12/1981 Brunossom et al. ..... 81/427.5
4,532,680 8/1985 Hashimoto ..... 24/67.5 X
4,830,322 5/1989 Gary ..... 248/206.5
4,953,862 9/1990 Uke et al. ..... 273/75
5,105,648 4/1992 Steiner et al. ..... 81/427.5 X

*Primary Examiner*—James R. Brittain
*Attorney, Agent, or Firm*—Paul M. Denk

[57] ABSTRACT

A binder clip includes a clamping element, a pair of opposed gripping means which when compressed open and close the clamping element and sleeves covering the opposed gripping means, the improvement comprising a sleeve of soft pliable plastic having an aperture for inserting over the opposed gripping means and a magnetic component located within at least one of the sleeves, and for use for holding the element to a metallic surface.

9 Claims, 1 Drawing Sheet

PLASTIC COVERED BINDER CLIP

BACKGROUND OF THE INVENTION

The present invention relates to a binder clip and more particularly to a binder clip that includes a pair of opposed gripping means each having a sleeve made of a soft pliable material wherein at least one of the sleeves contains a magnetic component.

Binder clips for securing items are old in the art. Binder clips are frequently used to consolidate several individual pieces of paper. The standard binder clips have opposed gripping means which are rigid and difficult to grip, therefore they may cause discomfort to the individual user. Some forms of binder clips contain a magnetic component so the clip may be attached to any ferrous surface. However, the magnetic binder clips are also made of a rigid material which may cause scrapping or other damage to the metal surface where the binder clip is attached.

SUMMARY OF THE INVENTION

One of the objects of the present invention is to provide a binder clip that includes a magnetic component that will not damage ferrous surfaces.

Another object is to provide such a binder clip that includes sleeves made of a soft, pliable material that is easy to grip and will not cause discomfort to the individual user.

Another object is to provide such a binder clip that includes sleeves which easily slip onto the opposed gripping means of the binder clip.

Another object is to provide such a binder clip which may be easily converted into a memo holder.

Another object is to provide a sleeve for a binder clip that may be imprinted with advertising script, identifying indicia, or the like.

Other objects of this invention will be apparent to those skilled in the art in light of the following description and accompanying drawings.

In accordance with this invention, generally stated, a binder clip is provided which includes a clamping element to secure and or consolidate items, a pair of opposed gripping means which when compressed open and close the clamping element, sleeves sized to slip over at least one of the opposed gripping means. The sleeves are made of a soft, pliable material, and have an opening at the proximal end for inserting over the opposed clips. The interior of at least one of the soft, pliable sleeves includes a magnetic component. The magnetic component allows the binder clip to be secured to any ferrous surface. And the soft pliable polymer sleeves which cover the opposed gripping means prevent damage to ferrous surfaces and eliminate discomfort to the user. In addition, the sleeves may contain print material.

DESCRIPTION OF THE PREFERRED EMBODIMENT

Figure 1:
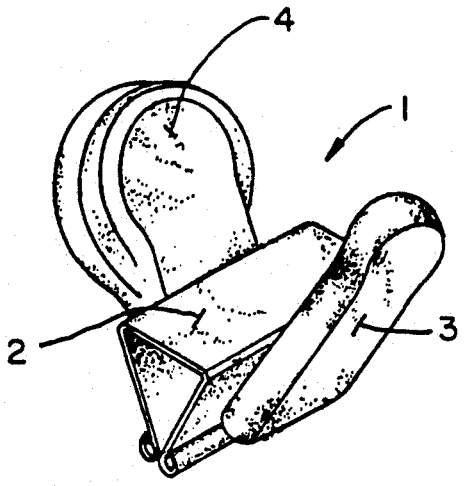
FIG. 1 is an isometric view of the inventive binder clip in closed position, looking angularly downwardly thereon.
Figure 2:
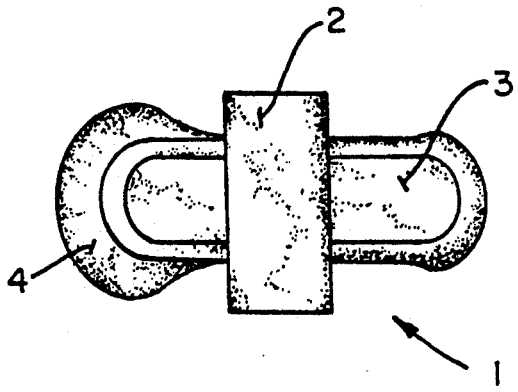
FIG. 2. is a top plan view of the binder clip in closed position.
Figure 3:
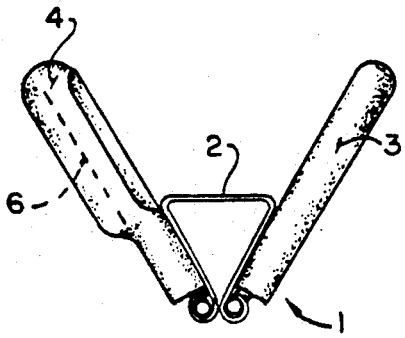
FIG. 3. is a right side elevational view of FIG. 1.
Figure 4:
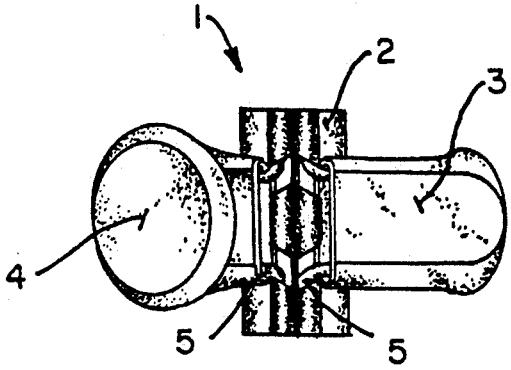
FIG. 4. is a bottom plan view of the binder clip in closed position.
Figure 5:
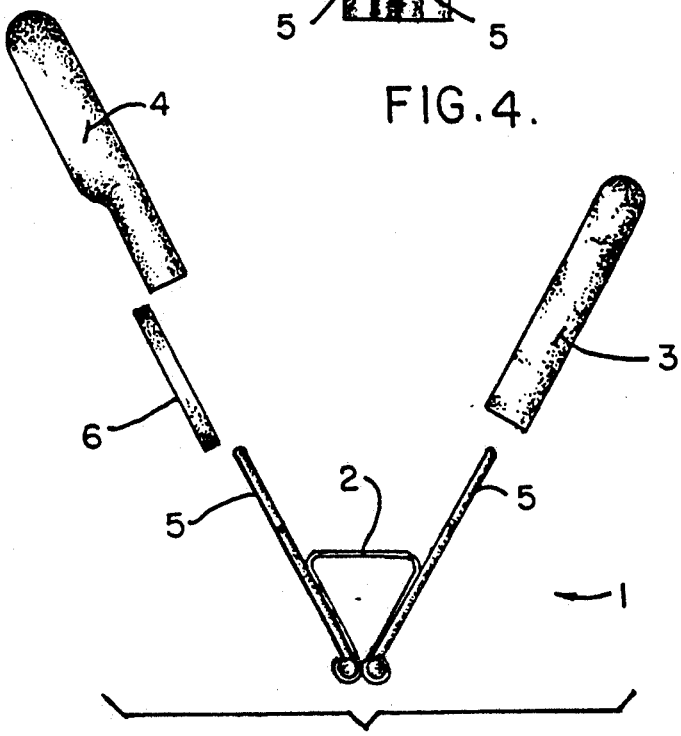
FIG. 5 is an exploded view of FIG. 3.

Referring to FIGS. 1-5 of the drawings, the novel binder clip broadly referred to by reference numeral 1, includes a clamping element 2. The clamping element 2 is opened and closed by a pair of opposed gripping means 5, the opposed gripping means are covered by sleeves 3 and 4, at least one of the sleeves 4, contains a magnetic component 6.

The binder clip 1 secures items with the clamping element 2. The distal end of the opposed gripping means 5 are compressed to open the clamping element 2 so that items may be inserted into the clamping element 2, and secured into place. The clamping element 2 is closed by releasing the opposed gripping means 5 and allowing the distal ends of the opposed gripping means 5, to separate. The opposed gripping means 5 are covered with sleeves 3 and 4. The sleeves 3 and 4 are made of a soft pliable material. The less rigid material is easier to grip and causes less discomfort to the user than the standard binder clips. At least one sleeve 4, contains a magnetic component 6. The magnetic component 6 is plastic coated to form a sleeve 4. The plastic coating eliminates damage to ferrous surfaces where the binder clip 1 is attached. The magnetic component 6 allows the hinder clip 1 to function as a memo holder which can be attached to any ferrous surface.

The pliable material may be formed or molded of a plastic, such as a vinyl. The sleeve 4 includes an enlarged flattened surface, to accommodate the clip's magnetic attachment to a metallic surface. Furthermore, the sleeves may be imprinted with data, such as a company name, for use for advertising and promotional purposes also.

Numerous variations, within the scope of the appended claims, will be apparent to those skilled in the art in light of the foregoing description and accompanying drawings. It is intended that all matter contained in the above-description or shown in the accompanying drawings shall be interpreted as illustrative and not in a limiting sense.

Having thus described the invention, what is claimed and desired to be secured by Letters Patent is:

1. A binder clip comprising a clamping element for securing items, a pair of opposed gripping means, said gripping means being biased into a clamping condition for securing items within said clamping element, said gripping means when compressed open may have items inserted into said clamping element, but when released into closure providing for the clamping element to secure any items, sleeves sized to fit over at least one of said opposed gripping means, said sleeves being formed of soft, pliable material, said sleeves including at least one aperture at each of their proximal ends for individually inserting over said opposed gripping means, and the interior of at least one of said sleeves having a magnetic component located therein, to provide for adherence of the binder clip to a magnetically susceptible surface.

2. The binder clip of claim 1 wherein said magnetic component is positioned at an inner distal end of one of said sleeves.

3. In a binder clip comprising a clamping element for securing items, including a pair of opposed gripping means formed of the clamping element, said gripping means when compressed open provide for the insertion of items within said clamping element and when released providing for closure of the clamping element about the secured items, the improvement comprising sleeves sized to fit over at least one of the gripping means, and the interior of said at least one sleeve including a magnetic component inserted therein providing for adherence of the binder clip to a magnetically susceptible surface.

4. The binder clip of claim 3 wherein said at least one sleeve having an integrally enlarged distal inner end to accommodate the forced insertion of the magnetic component therein.

5. The binder clip of claim 3 wherein said magnetic component is annualar.

6. The binder clip of claim 3 wherein said sleeves are made of soft, pliable material.

7. The binder clip of claim 6, wherein said material is a polymer.

8. The binder clip of claim 7 wherein said polymer is vinyl.

9. The binder clip of claim 8 wherein said sleeves have a surface to accommodate print material.

* * * * *